US005749746A

United States Patent [19]

Tan et al.

[11] Patent Number: 5,749,746

[45] Date of Patent: May 12, 1998

[54] CABLE CONNECTOR STRUCTURE

[75] Inventors: Haw-Chan Tan; Frank C. Ma, both of Diamond Bar, Calif.

[73] Assignee: Hon Hai Precision Ind. Co., Ltd., Taiwan

[21] Appl. No.: 534,049

[22] Filed: Sep. 26, 1995

[51] Int. Cl.[6] ..... H01R 13/54

[52] U.S. Cl. ..... 439/357; 439/358

[58] Field of Search ..... 439/350–358, 439/610, 493

[56] References Cited

U.S. PATENT DOCUMENTS

| | | | |
|---|---|---|---|
| 4,838,808 | 6/1989 | Fujiura | 439/357 |
| 4,936,793 | 6/1990 | Uchida | 439/357 |
| 5,213,533 | 5/1993 | Walden | 439/358 |
| 5,380,223 | 1/1995 | Marsh et al. | 439/610 |
| 5,383,794 | 1/1995 | Davis et al. | 439/352 |
| 5,411,402 | 5/1995 | Bethurum | 439/493 |
| 5,449,298 | 9/1995 | James et al. | 439/352 |
| 5,533,908 | 7/1996 | Henry et al. | 439/353 |

*Primary Examiner*—Hien Vu

[57] ABSTRACT

A cable connector includes a casing having two members ultra-sonically jointed to define therein an interior space for receiving a connector body which has a coupling end to couple to a counterpart connector with a plurality of slots formed therein, wherein the respective slot receives a connection pin, for establishing signal channel with a counterpart connector. A cable containing a number of conductors has a joint end received within the casing to allow the conductors to be electrically connected to the connector body via a circuit board. The joint end of the cable has two opposite shoulders each having a front face and an opposite rear face to be snugly receive within a chamber defined within the casing by two spaced wall segments with the front and rear faces thereof in abutment relationship with the wall segments to provide resistance to external force acting upon the cable. Each of the shoulders of the cable is provided with a hole into which a peg formed inside the respective chamber is received to provide a further resistance to the external force. The casing is further provided with two lock-in spring plates at two opposite sides thereof, each having a retaining section fixed inside the casing and a lock-in section outside the casing for securing the connector to the counterpart connector, a pushbutton section being integrally connected between the retaining section and the lock-in section to form a single piece member. The pushbutton section is accessible by a user to release the connector from the counterpart connector.

10 Claims, 4 Drawing Sheets

CABLE CONNECTOR STRUCTURE

FIELD OF THE INVENTION

The invention relates generally to an electrical connector and in particular to a connector for connecting a cable wire comprising a number of conductors to an I/D card, such as those used in a telecommunication network system.

BACKGROUND OF THE INVENTION

Electrical connectors of the above-mentioned type have been widely used to joint a communication cable wire to an I/D card, wherein the connector comprises a casing inside which a connector body with an end of a cable electrically connected thereto is secured. The connector body may be either a female structure or a male structure and the mated female or male connectors are jointed to establish a releasable electrical connection between two cables. A pair of lock-in spring plates with a separate manual operation pushbutton is provided on the casing in an opposite manner to allow a user to depress with for example thumb and index finger. The lock-in spring plates are provided with projections to engage corresponding notches or slots formed on the counterpart connector so as to secure the connector to the counterpart connector.

It is however found that the structure of the conventional electrical connector of this kind has some disadvantages, such as:

(a) The cable wire has a plurality of thin conductors contained therein to be individually soldered to the connector body and the soldering of each of the thin conductors to the connector body is usually weak and not capable to sustain great forces. If a force trying to separate the two connectors is not directly applied to the casing or the connector body and instead, it acts upon the cable wires, the weak soldering joint between the cable conductors and the connector body may be damaged.

(b) In the prior art, the casing which is composed of two pieces makes use of mechanical connections, such as screws or snap-on type connection, to secure the two pieces together and such kinds of mechanical connections often lose their effectiveness in securing during a long term use.

(c) The connector body that is enclosed inside the casing and to which the cable wire is soldered needs to be protected by insulation material from short-circuiting and conventionally, this is done by embedding the connector body in the insulation material, such as rubber or plastics, by filling the insulation material in the liquid state around the connector body and allowing the insulation material to cure. This is a time- and labor-consuming work. Further, during such a filling process, the soldering between the conductors of the cable and the connector body may be damaged. Besides, once there is any breaking-off occurring at any one of the conductors and its associated soldering to the connector body that are enclosed by the insulation material, the whole device needs to be discarded and replaced by a new one and no repairing is possible for such a conventional structure.

(d) The conventional connector has fixed inherent connection keys or pins extending from the connector body to couple to the counterpart connectors for mating with the right and pre-determined counterpart connector and this does not allow to selectively disable or remove any one of the connection pins for alternative applications.

(e) The lock-in device of the conventional design requires a separate pushbutton and this increases the manufacturing complexity and cost.

In view of the above discussed drawbacks, it is desirable to provide an improved cable connector which overcomes these drawbacks occurring in the conventional design.

SUMMARY OF THE INVENTION

An object of the present invention is to provide a cable connector which overcomes the drawbacks of the conventional design by providing a single piece lock-in spring plate on which a pushbutton is integrally formed to reduce the manufacturing complexity and cost.

It is another object of the present invention to provide a cable connector wherein a structure to protect the soldering between the cable and the connector body from being acted upon by external pulling force is provided between the casing and the joint end of the cable that is retained within the casing.

It is another object of the present invention to provide a cable connector in which the two casing members are jointed together by means of ultra-sonic welding.

It a further object of the present invention to provide a cable connector which uses two separate insulation pads to replace the conventionally-used insulation enclosure in which the connector body is embedded for protection from short-circuiting.

It is yet another object of the present invention to provide a cable connector in which the connection pins that bridge the connector body with that of a counterpart connector to form signal channels is selectively detachable or removable from the connector body so as to determine the right connection between the two connectors at a selected signal channel.

To achieve the above objects, there is provided a cable connector comprising a casing having two members ultrasonically jointed to define therein an interior space for receiving a connector body which has a coupling end to couple to a counterpart connector with a plurality of slots formed therein, wherein the respective slot receives a connection pin, for establishing signal channel with a counterpart connector. A cable containing a number of conductors has a joint end received within the casing to allow the conductors to be electrically connected to the connector body via a circuit board. The joint end of the cable has two opposite shoulders each having a front face and an opposite rear face to be snugly receive within a chamber defined within the casing by two spaced wall segments with the front and rear faces thereof in abutment relationship with the wall segments to provide resistance to external force acting upon the cable. Each of the shoulders of the cable is provided with a hole into which a peg formed inside the respective chamber is received to provide further resistance to the external force. The casing is further provided with two lock-in spring plates at two opposite sides thereof, each having a retaining section fixed inside the casing and a lock-in section outside the casing for securing the connector to the counterpart connector, a pushbutton section being connected between the retaining section and the lock-in section to form a single piece member. The pushbutton section is accessible by a user to release the connector from the counterpart connector.

BRIEF DESCRIPTION OF THE DRAWINGS

Other features and advantages of the present invention will become apparent in the following detailed description of a preferred embodiment of the invention, with reference to the attached drawings, wherein.

DETAILED DESCRIPTION OF THE PREFERRED EMBODIMENT

Figure 1:
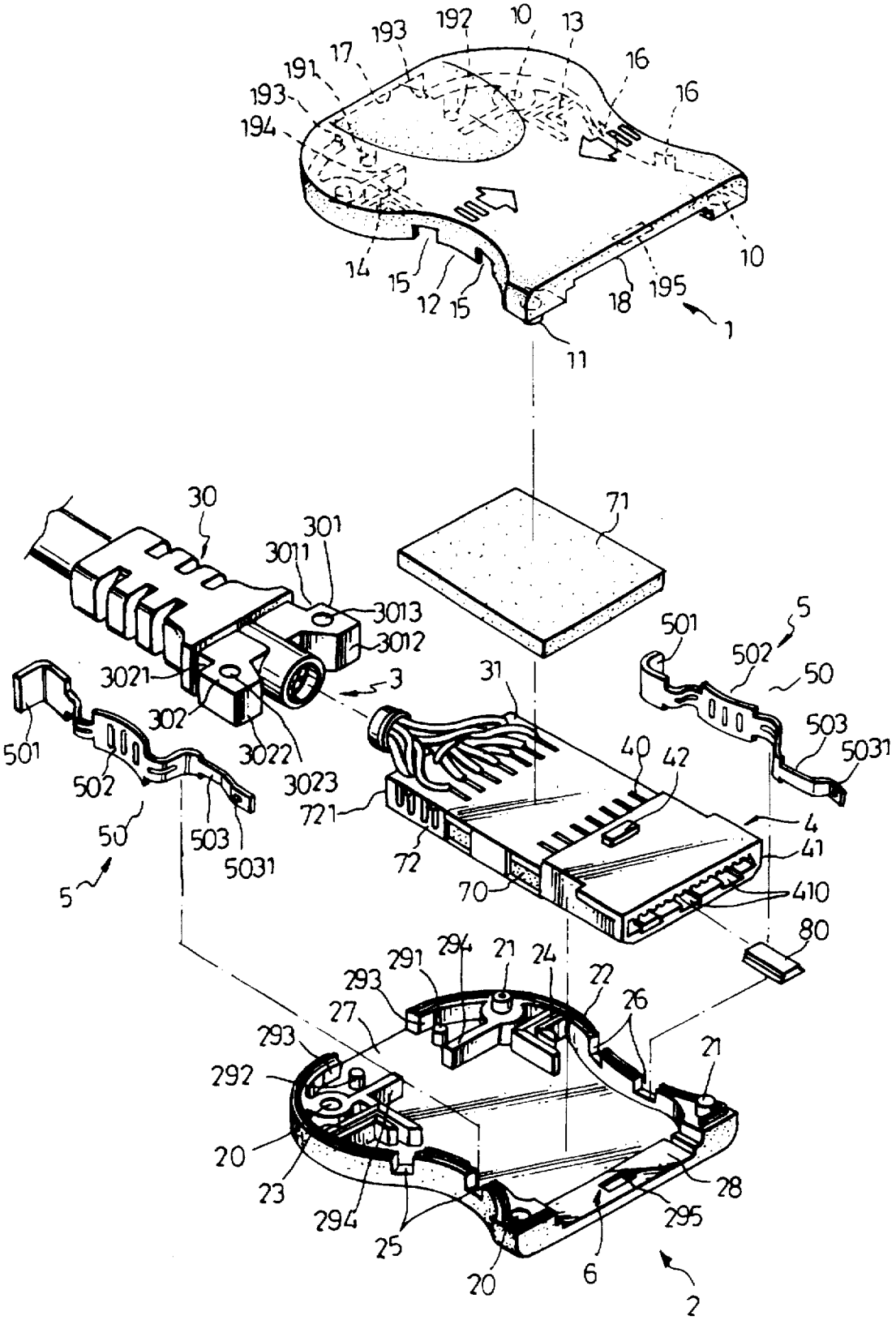
FIG. 1 is an exploded perspective view showing a cable connector constructed in accordance with the present invention.
Figure 2:
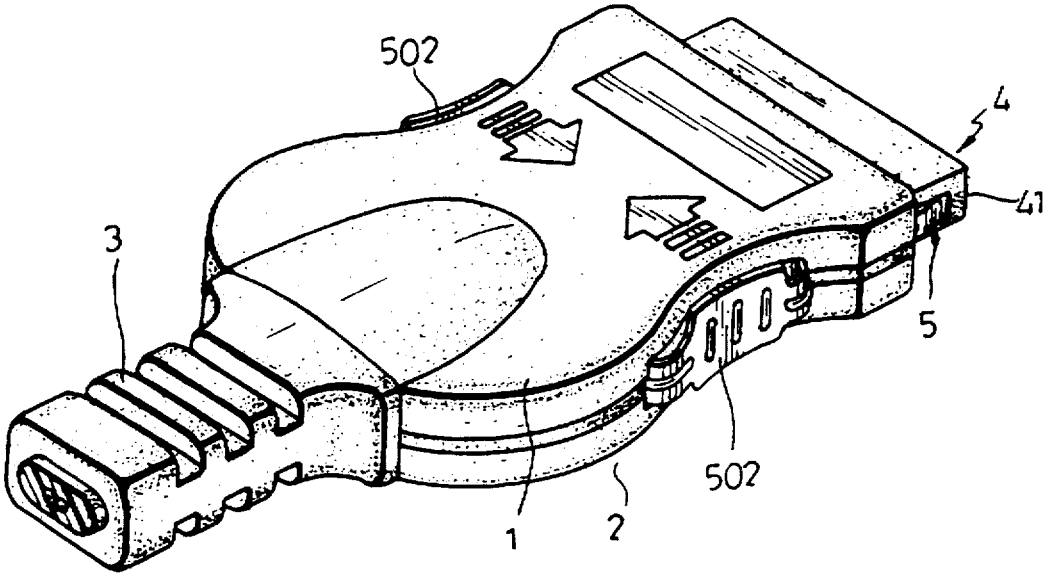
FIG. 2 is a perspective view showing the cable connector constructed in accordance with the present invention.

With reference to the drawings and in particular to FIGS. 1 and 2, wherein a cable connector constructed in accordance with the present invention is shown, the cable connector of the present invention comprises a casing having a first member 1 and a second member 2, both being substantially identical, to mate each other for defining therebetween an interior space within which a connector body 4 is received. Each of the casing members 1 and 2 has a front notch 18 or 28 and a rear notch 17 or 27. The front notches 18 and 28 of the casing members 1 and 2 together define a front opening of the casing through which a coupling end 41 of the connector body 40 extends outward. The rear notches 17 and 27 of the casing members 1 and 2 together define a rear opening of the casing through which a joint end 30 of a cable 3, containing a number of conductors, extends to joint the connector body 4 by means of soldering.

Each of the casing members 1 and 2 is composed of a substantial plate member on which a circumferential side wall surrounds to define therein a recessed space which, when the two casing members 1 and 2 mate, forms the interior space of the casing. The front notch 28 (or 18) and the rear notch 27 (or 17) are defined on the side wall of the casing member 2 (or 1) to divide the side wall into two substantially symmetrical sections.

Besides the front and rear notches 28 and 27, each section of the side wall of the second casing member 2 also has two further notches 25 or 26 formed thereon. The notches 25 and 26 are arranged to be opposite to each other. The first casing member 1 has similar notches 15 and 16 formed on the side wall thereof.

The second casing member 2 also comprises, associated with each section of the side wall thereof, an L-shaped slot 23 or 24 formed therein, preferably defined by inner walls mounted within the recessed space defined by the side wall. The first casing member 1 has similar L-shaped slots 13 and 14 formed thereon to be opposite to and cooperate with the L-shaped slots 23 and 24 of the second casing member 2 for mounting lock-in means 5 within the casing. This will be further described hereinafter.

Each of the casing members 1 and 2 has formed in the proximity of the rear notch 17 or 27 thereof cable retaining means which comprises a segment 193 or 293 of each of the side wall section that is adjacent to the rear notch 17 or 27. In other words, the rear notch 17 of the first casing member 1 is formed between the two wall segments 193 and the notch 27 of the second casing member 2 is formed between the two wall segments 194. Opposite to and inwardly spaced from each of the wall segments 193 or 293 is an interior wall segment 194 or 294 which defines with the respective outer wall segment 193 or 293 a receiving chamber therebetween. Two pegs 291 and 292 respectively located within the receiving chambers extend from the plate of the second casing member 2 to be substantially flush with the side wall of the second casing member 2. Similarly, two pegs 191 and 192 respectively located within the receiving chambers extend from the plate of the first casing member 1 to be substantially flush with the side wall of the first casing member 1.

Figure 3:
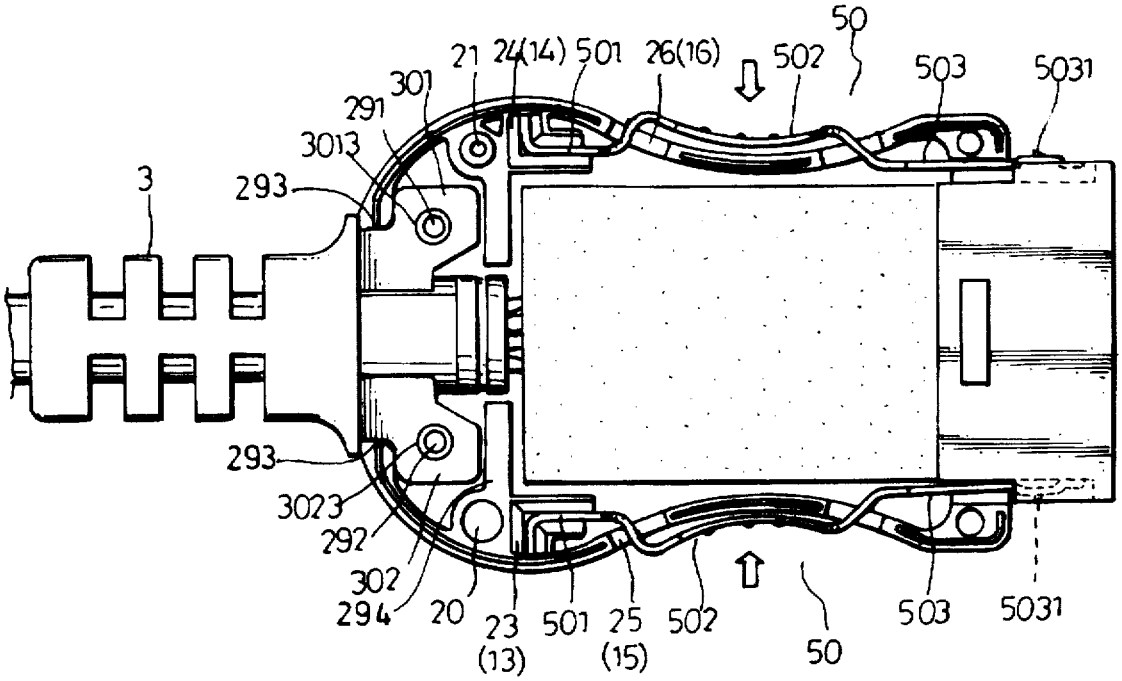
FIG. 3 is a plan view of the cable connector of the present invention with a top casing removed to illustrate the inside structure thereof.

The joint end 30 of the cable 3 comprises two spaced, opposite shoulders 301 and 302, each being configured so as to be fit into a respective receiving chamber defined by the inner wall segment 194 or 294 and its respective outer wall segment 193 or 293. Each of the shoulders 301 and 302 has a hole 3013 or 3023 formed thereon, corresponding to the pegs 191, 291 and 192, 292 to receive therein the respective peg 191, 291 or 192, 292, see FIG. 3. The engagement between the holes 3013, 3023 and the pegs 191, 192 and 291, 292 provides a strong physical connection between the cable 3 and the casing and also provides a better resistance via a force separation of the cable 3 in the casing from the weak soldering of the conductor when an external pulling force is applied on the cable 3, to protect the soldering of the conductors of the cable 3 to the connector body 4.

Moreover, each of the shoulders 301 and 302 is provided with a front face 3012 or 3022 to be in close abutment relationship with the respective inner wall segment 194, 294 and a rear face 3011 or 3021 to be in close abutment relationship with the respective outer wall segment 193, 293. With the abutment between the shoulders 301, 302 and the inner and outer wall segments 193, 293 and 194, 294, the joint end 30 of the cable 3 is much more securely held within the casing, see FIG. 3.

Retaining means 6 is provided between the casing members 1, 2 and the connector body 4, comprising a retaining slot 195 or 295 formed on each of the casing members 1 and 2, preferably in the proximity of the front notch 18 or 28 thereof, to engagingly receive therein a raised portion 42 formed on the connector body 4. The engagement between the raised portions 42 of the connector body 4 and the retaining slots 195 and 295 of the casing members 1 and 2 helps preventing the connector body 4 from being forcibly pulled out of the casing in a front-to-end direction.

As shown in FIG. 1, the connector body 4, which in the embodiment illustrated has a known structure particularly suitable for use in a telecommunication network system and well known to those skilled in the art of telecommunication, comprises a plurality of conductive terminals 40 which are electrically connected to a circuit board 31 by means of for example soldering. The circuit board 31 is in turn connected to the joint end 30 of the cable 3 by any means known to those skilled in the art so as to establish electrical connection between the cable 3 and the connector body 4.

Figure 4:
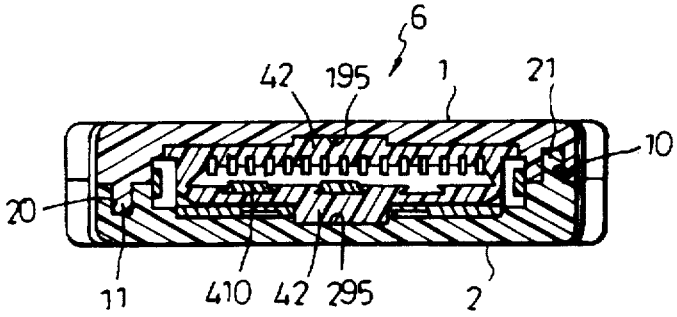
FIG. 4 is a sectional elevation of the cable connector of the present invention.

The connector body 4 is provided on the coupling end 41 thereof with a plurality of slots 410, preferably in the form of dovetail to each selectively receive therein a connection pin 80 having a portion projecting out of the respective slot 410 to be received within a counterpart connector (not shown) to define one signal channel therebetween. Although there is only one connection pin 80 shown in FIG. 1, there can be more than one of the dovetail slots 410 having a connection pin 80 received therein, such as that shown in FIG. 4, in which two of the three dovetail slots 410 have a connection pin 80 received therein. The connection pins 80 are releasably received within the dovetail slots 410 and can be removed to disable the signal channel associated therewith. Since the use of a connection pin 80 in any one of the dovetail slots 410 is optional, it is thus possible to disable and/or enable signal connection at any one of the channels defined by the dovetail slots 410 between two mating cable connectors.

Insulation pads, such as foam pads 70 and 71 are respectively provided on two opposite sides of the circuit board 31 to provide insulation and protection of the circuit board 31 from short-circuiting.

A shielding metal enclosure 72 may be provided to the circuit board 31, preferably enclosing one of the insulation pads, such as 70 in FIG. 1. The enclosure 72 may be provided an extension (not shown in the drawings) for grounding.

The lock-in means 5 comprises two identical, spaced apart spring plates 50, sandwiched and secured between the two casing members 1 and 2. The spring plates 50 comprise a retaining section 501 and a lock-in section 503 with a pushbutton section 502 connected in-between to form a single piece member, where the pushbutton section 502 is somewhat offset outward with regard to the retaining section 501 and the lock-in section 503. The retaining section 510 is to be retained on the casing members 1 and 2 which in the embodiment illustrated is done with an L-shaped bending snugly receivable within the respective L-shaped slots 14 and 24 of the first and second casing members 1 and 2 and retained therein. The side walls of the casing members 1 and 2 and the spring plates 50 are so shaped that each of the spring plates 50 extends through both the notches 15, 25 or 16, 26 to have the pushbutton section 502 located outside the casing at a first position (as shown by the upper spring plate 50 in FIG. 3) where the pushbutton section 502 is away from the casing and thus accessible by a user. In the embodiment illustrated, normally, the spring plates 50 are located at the first position.

The lock-in section 503 of each of the spring plates 50 comprises a locking projection 5031 which is receivably engageable with notches or slots provided on the counterpart connector (not shown) when the pushbutton sections 503 are located at the first position to secure them together. The notches 15, 16, 25 and 26 are so dimensioned as to allow the pushbutton sections 502 of the spring plates 50 to be manually depressible from the first position toward a second position (as shown by the lower spring plate 50 in FIG. 3) where the pushbutton sections 503 are close to the casing and the locking projections 5031 of the lock-in sections 503 are moved to disengage from the notches or slots of the counterpart connector (not shown) so as to release the connection of the connector body 4 with the counterpart connector (not shown). The single piece lock-in means 5 provides a simple structure and thus a lower manufacturing cost and a more durable service life, as compared to the multiple piece design of the prior art.

Each of the casing members 1 and 2 is preferably provided with a dwell pin 11 or 21 and a corresponding hole 10 or 20 to help positioning the casing members 1 and 2 relative to each other during manufacturing.

On the side wall of each of the casing members 1 and 2, a joint rib 12 or 22 is provided. The ribs 12 and 22 are preferably overlapping and in tight contact engagement with each other during assembly. Ultrasonic welding technique is then used to fuse the ribs 12 and 22 together so as to secure the casing members 1 and 2 together.

Further, it is quite apparent that arrows indicating depressing direction of the pushbutton sections 502 may be provided on the casing members 1 and 2, as shown in FIGS. 1 and 2. Moreover, the pushbutton sections 502 may be provided with raised strips or serration for easy griping by fingers, as shown in FIGS. 1 and 2.

Figure 5:
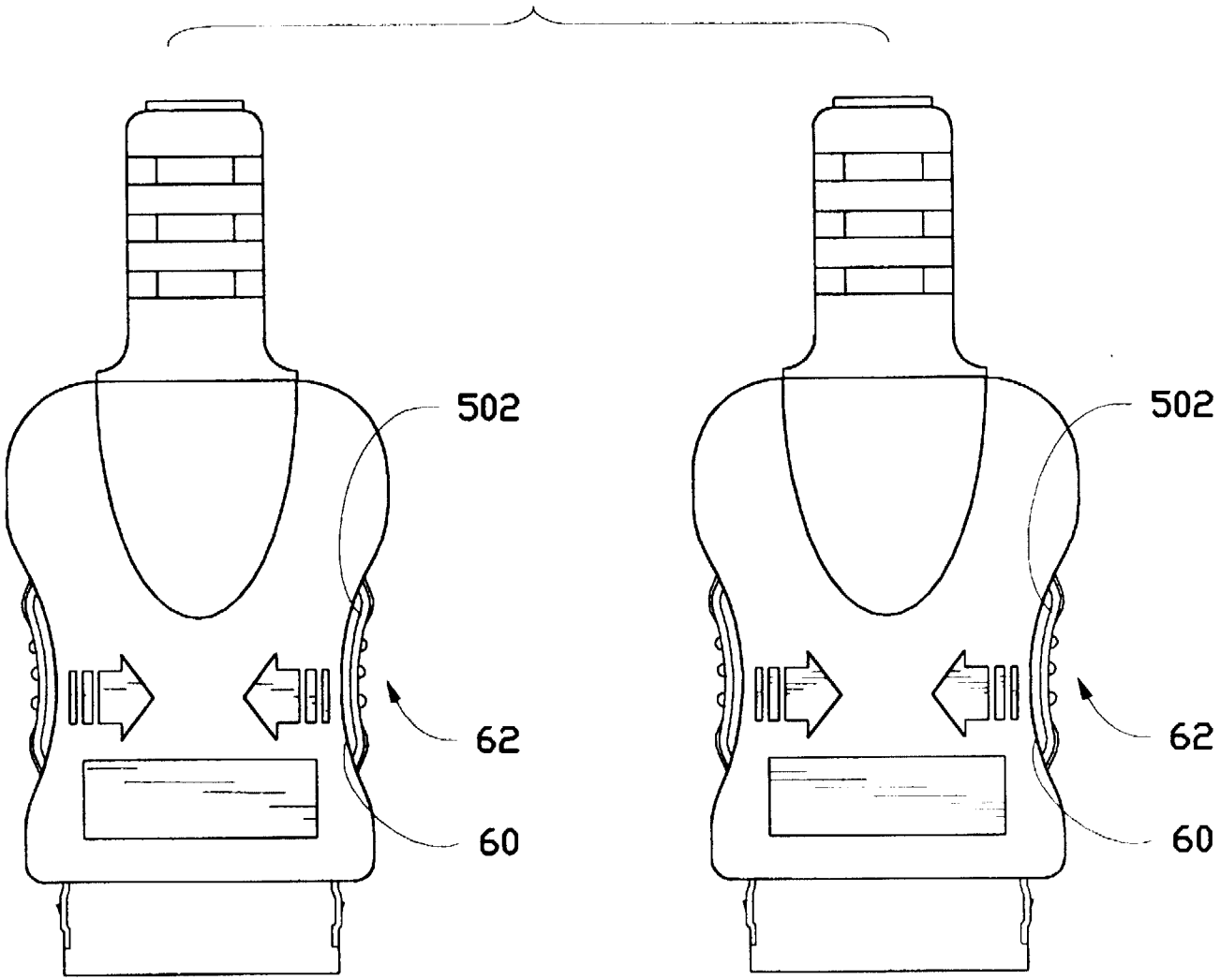
FIG. 5 is a plan view of two cable connectors of the present invention which are close side by side positioned together to show the narrowed waist section of such two opposite connectors, providing a sufficient space therebetween for easy access to and operation of the pushbuttons thereof.

As shown in FIG. 5, a pair of cable connectors may be close side by side positioned to engage with two corresponding counterpart connectors (not shown), respectively, wherein such two counterpart connectors are arranged in a side-by-side close relationship in compliance with the specification of the computer configuration. Because each cable connector is generally of a sand-glass shape having a converging waist section 60 thereof, and the pushbutton section 502 of the spring plate 50 substantially complies with the periphery of the converging waist section 60, a football-shaped space 62 is formed between the two opposite waist sections 60 of the two adjacent juxtaposed cable connectors whereby such space 62 is sufficiently large to allow a finger to enter for pressing against the pushbutton section 502 extending in such space 62, thus releasing the spring plate 50 from the counterpart connector. It can be seen that the pushbutton section 502 somewhat extends out of the periphery of the converging waist section 60 and into the space 62 to a minimum extent for a sufficiently large spacing remaining in the space 62 for finger access and operation. Differently, the conventional cable connector as shown in U.S. Design Pat. No. 351,135 lacks the converging section around the pushbutton section of the lock-in means, and the pushbutton section thereof also lacks a similar converging configuration thereof, so that it will be inconvenient or even inoperable to press the corresponding lock-in means as two conventional cable connectors are closely side by side positioned together in compliance with the predetermined specification of the computer dimension.

It is apparent that although the invention has been described in connection with the preferred embodiment, it is contemplated that those skilled in the art may make changes to the preferred embodiment without departing from the scope of the invention as defined in the appended claims.

What is claimed is:

1. A cable connector comprising:

a casing defining therein an interior space having a first and a second openings;

a connector body disposed within the interior space of the casing with a coupling end partially projecting out of the first opening of the casing adapted to couple to a counterpart connector;

a cable containing at least one conductor, having a joint end received within the casing through the second opening of the casing with said at least one conductor electrically connected to the connector body with a connection means including a circuit board soldered to the connector body and in electrical connection with said at least one conductor;

a pair of insulation pads attached to two opposite surfaces of the circuit board for enclosing and protecting the circuit board; and lock-in means comprising two spring plates, each having a rear retaining section retained within the casing and a front lock-in section projecting out of the casing to be movable between a first position where the lock-in section engages a counterpart lock-in member provided on the counterpart connector to secure the cable connector to the counterpart connector and a second position where the lock-in section disengages from the counterpart lock-in member of the counterpart connector, a pushbutton section being integrally connected between the retaining section and the lock-in section and user-operable to move the lock-in section between the first and second positions; wherein the lock-in section of each of the spring plates comprises a projection formed thereon adapted to be engageable with a notch formed on the counterpart lock-in member of the counterpart connector.

2. The cable connector as claimed in claim 1, wherein the retaining section of each of the spring plates comprises an L-shaped bending to be snugly received within an L-shaped slot formed inside the casing.

3. The cable connector as claimed in claim 1, wherein the pushbutton section of each of the spring plates comprises raised strips formed thereon.

4. The cable connector as claimed in claim 1, wherein the pushbutton section is relatively offset outward with regard to the retaining section and the lock-in section, and the casing comprising at least two notches for allowing said pushbutton section to extend to an exterior for access from the exterior.

5. The cable connector as claimed in claim 1, wherein the casing comprising a first casing member and a second casing member jointed together to form the casing.

6. The cable connector as claimed in claim 1, wherein the connector body comprises retaining means for securely retaining the connector body within the casing.

7. A cable connector for connecting to a counterpart connector, comprising:

a casing defining therein an interior space having a first and a second ends;

connector body disposed within the interior space of the casing adjacent said first end with a coupling end adapted to engage said counterpart connector;

a cable containing at least one conductor connected to said second end;

lock-in means comprising at least a lock-in section to engage a counterpart lock-in member of the counterpart connector and a retaining section retained within the casing; and at least a pushbutton intermediating between and laterally offset to said lock-in section and said retaining section, wherein said casing includes at least a converging waist section, wherein said casing includes at least a converging waist section defining a spacing thereabout, and said pushbutton having a curve portion which complies with and projects out of a contour of said converging waist section, said curve portion being bent into the spacing to a minimum extent for a sufficiently large space remaining in the spacing for finger external access and operation, wherein said casing has at least two notches in said converging waist section for said pushbutton extending therethrough.

8. A cable connector assembly including two cable connectors for coupling to a pair of counterpart connectors which are close side by side positioned together, each of said connectors of said cable connector assembly comprising:

a casing defining therein an interior space having a first and a second ends;

a connector disposed within the interior space of the casing adjacent said first end with a coupling end adapted to engage one of said counterpart connectors;

a cable containing at least one conductor connected to said second end;

lock-in means comprising a rear retaining section retained within the casing and a front lock-in section to engage a counterpart lock-in member of the counterpart connector; and at least a pushbutton being integrally connected between said retaining section and said lock-in section;

said casing of one of said two cable connectors including at least a converging waist section facing to another adjacent converging waist section of the casing of the other of said two cable connectors said converging waist sections being curved inwardly toward respective interior spaces of said two cable connectors and in opposite directions so as to define a spacing between said two opposite converging waist sections of said two cable connectors, wherein said two cable connectors are side by side positioned in a close spaced relationship and said pushbuttons each having a curve portion which complies with and projects out of a contour of said converging waist section, said curve portion being bent into the spacing to a minimum extent for a sufficiently large space remaining in the spacing for finger external access and operation.

9. The cable connector assembly as claimed in claim 8, wherein said casing comprises at least two notches in said converging waist section for said pushbutton extending therethrough.

10. A cable connector comprising:

a casing defining therein an interior space having a first and a second openings;

a connector body disposed within the interior space of the casing with a coupling end partially projecting out of the first opening of the casing adapted to couple to a counterpart connector;

a cable containing at least one conductor, having a joint end received within the casing through the second opening of the casing with said at least one conductor electrically connected to the connector body with a connection means; and lock-in means comprising two spring plates, each having a retaining section retained within the casing and a lock-in section projecting out of the casing to be movable between a first position where the lock-in member provided on the counterpart connector to secure the cable connector to the counterpart connector and a second position where the lock-in section disengages from the counterpart lock-in member of the counterpart connector, a pushbutton section being integrally connected between the retaining section and the lock-in section and user-operable to move the lock-in section between the first and second positions, wherein the connection means for electrically connecting the end of the cable to the connector body comprises a circuit board soldered to the connector body and in electrical connection with at least one conductive of the cable and the circuit board has two opposite surfaces to each of which an insulation pad is attached, to enclose and protect the circuit board.

* * * * *